US010631393B2

(12) United States Patent
Hori

(10) Patent No.: US 10,631,393 B2
(45) Date of Patent: Apr. 21, 2020

(54) CHAMBER DEVICE AND EXTREME ULTRAVIOLET LIGHT GENERATING DEVICE

(71) Applicant: GIGAPHOTON INC., Tochigi (JP)

(72) Inventor: Tsukasa Hori, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 16/182,799

(22) Filed: Nov. 7, 2018

(65) Prior Publication Data

US 2019/0075642 A1 Mar. 7, 2019

Related U.S. Application Data

(63) Continuation of application No. PCT/JP2016/067548, filed on Jun. 13, 2016.

(51) Int. Cl.
*H05G 2/00* (2006.01)

(52) U.S. Cl.
CPC ..... *H05G 2/008* (2013.01); *H05G 2/006* (2013.01); *H05G 2/005* (2013.01)

(58) Field of Classification Search
None
See application file for complete search history.

(56) References Cited

U.S. PATENT DOCUMENTS 7,948,673 B2 * 5/2011 Yoshimura ..... G02F 1/37 359/326
2008/0069157 A1 * 3/2008 Ariga ..... H01S 3/2308 372/21
2008/0179548 A1 * 7/2008 Bykanov ..... B82Y 10/00 250/504 R
2009/0080475 A1 * 3/2009 Yoshimura ..... G02F 1/37 372/22
2009/0250637 A1 * 10/2009 Akins ..... G03F 7/70033 250/492.1
2010/0171049 A1 * 7/2010 Moriya ..... H05G 2/003 250/504 R (Continued)

FOREIGN PATENT DOCUMENTS

JP H09-213496 A 8/1997
JP H11-274609 A 10/1999

(Continued)

OTHER PUBLICATIONS

International Search Report issued in PCT/JP2016/067548; dated Aug. 23, 2016.

(Continued)

*Primary Examiner* — Andrew Smyth
(74) *Attorney, Agent, or Firm* — Studebaker & Brackett PC

(57) ABSTRACT

A chamber device according to one aspect of the present disclosure includes a chamber inside which plasma is generated, a light source, and an incidence window configured to transmit light emitted from the light source to the inside of the chamber. The incidence window includes a first surface facing the outside of the chamber, and a second surface facing the inside of the chamber. At least the second surface is not coated with an anti-reflection film. The second surface is disposed in a state of being inclined at a non-perpendicular angle against an optical axis of the light emitted from the light source.

15 Claims, 10 Drawing Sheets

(56) References Cited

U.S. PATENT DOCUMENTS

| | | | | |
|---|---|---|---|---|
| 2010/0176310 | A1* | 7/2010 | Moriya | G03F 7/70033 250/493.1 |
| 2010/0181503 | A1* | 7/2010 | Yanagida | G03F 7/70033 250/504 R |
| 2010/0182579 | A1* | 7/2010 | Loopstra | G03B 27/54 355/55 |
| 2010/0258750 | A1* | 10/2010 | Partlo | H05G 2/003 250/504 R |
| 2012/0305809 | A1* | 12/2012 | Moriya | H05G 2/003 250/504 R |
| 2013/0015319 | A1* | 1/2013 | Moriya | G03F 7/70008 250/201.1 |
| 2015/0168848 | A1* | 6/2015 | Tanaka | G03F 7/70041 355/67 |
| 2015/0261095 | A1* | 9/2015 | Jansen | H05G 2/003 355/67 |
| 2015/0296602 | A1* | 10/2015 | Loopstra | G03F 7/7085 250/493.1 |
| 2016/0234920 | A1* | 8/2016 | Suzuki | H05G 2/003 |

FOREIGN PATENT DOCUMENTS

| | | | | | |
|---|---|---|---|---|---|
| JP | 2002-008891 | A | | 1/2002 | |
| JP | 2002-518823 | A | | 6/2002 | |
| JP | 2007-249092 | A | | 9/2007 | |
| JP | 2008-085075 | A | | 4/2008 | |
| JP | 2011-082473 | A | | 4/2011 | |
| JP | 2011082473 | A | * | 4/2011 | H05G 2/003 |
| JP | 2012-134447 | A | | 7/2012 | |
| JP | 2012134447 | A | * | 7/2012 | G03F 7/708 |
| WO | 99/65056 | A1 | | 12/1999 | |
| WO | WO-9965056 | A1 | * | 12/1999 | H01J 37/321 |
| WO | 2007-096965 | A1 | | 8/2007 | |

OTHER PUBLICATIONS

The International Preliminary Report on Patentability and Translation of Written Opinion of the International Searching Authority; PCT/JP2016/067548; dated Dec. 18, 2018.

* cited by examiner

CHAMBER DEVICE AND EXTREME ULTRAVIOLET LIGHT GENERATING DEVICE

CROSS-REFERENCE TO RELATED APPLICATIONS

The present application is a continuation application of International Application No. PCT/JP2016/067548 filed on Jun. 13, 2016. The content of the application is incorporated herein by reference in its entirety.

BACKGROUND

1. Technical Field

The present disclosure relates to a chamber device and an extreme ultraviolet light generating device.

2. Related Art

In recent years, along with microfabrication in the semiconductor manufacturing process, fine transfer patterns in photolithography of the semiconductor manufacturing process are developed rapidly. In the next generation, microfabrication of 20 nm or smaller will be required. Accordingly, it is expected to develop an exposure device in which a device for generating extreme ultraviolet (EUV) light having a wavelength of about 13 nm and a reflection reduction projection optical system are combined.

As EUV light generating devices, three types of devices are proposed, namely, a laser produced plasma (LPP) type device that uses plasma generated when a target material is irradiated with laser light, a discharge produced plasma (DPP) type device that uses plasma generated by discharging, and a synchrotron radiation (SR) type device that uses orbital radiation light.

CITATION LIST

Patent Literature

Patent Literature 1: Japanese Patent Application Laid-Open No. 2002-518823 Patent Literature 2: Japanese Patent Application Laid-Open No. 11-274609

SUMMARY

A chamber device, according to one aspect of the present disclosure, may include a chamber, a light source, and an incidence window. In the chamber, plasma may be generated. The light source may be disposed outside the chamber. The incidence window may be configured to transmit light emitted from the light source to the inside of the chamber. The incidence window may have a first surface facing an outside of the chamber, and a second surface facing the inside of the chamber and exposed to plasma light. At least the second surface out of the first surface and the second surface may not be coated with an anti-reflection film. The second surface may be disposed on a wall of the chamber in a state of being inclined at a non-perpendicular angle against an optical axis of the light emitted from the light source and passing through the incidence window.

An extreme ultraviolet light generating device, according to another aspect of the present disclosure, may include a chamber, a light source, an incidence window, an emission window, a light receiving unit, a target feeding unit, and a laser light introduction window. In the chamber, plasma may be generated. The light source may be disposed outside the chamber. The incidence window may be configured to transmit light emitted from the light source to the inside the chamber. The emission window may be configured to transmit the light emitted from the light source and passing through the inside of the chamber, from the inside of the chamber to an outside of the chamber. The light receiving unit may be disposed outside the chamber beyond the emission window. The light receiving unit may be configured to receive the light passing through the inside of the chamber and emitted from the emission window. The target feeding unit may be configured to feed a droplet of a target substance, serving as a source of generating the plasma, to the inside of the chamber. The laser light introduction window may be configured to transmit laser light to be radiated to the droplet and introduce the laser light into the chamber. The incidence window may have a first surface facing the outside of the chamber, and a second surface facing the inside of the chamber and exposed to plasma light. At least the second surface out of the first surface and the second surface may not be coated with an anti-reflection film. The second surface may be disposed on a wall of the chamber in a state of being inclined at a non-perpendicular angle against an optical axis of the light emitted from the light source and passing through the incidence window. The emission window may include a third surface facing the inside of the chamber and exposed to the plasma light, and a fourth surface facing the outside of the chamber. At least the third surface out of the third surface and the fourth surface may not be coated with an anti-reflection film. The third surface may be disposed on a wall of the chamber in a state of being inclined at a non-perpendicular angle against the optical axis of the light emitted from the light source and passing through the emission window. A target of the droplet, supplied from the target feeding unit into the chamber, may be irradiated with the laser light and made into plasma to thereby generate extreme ultraviolet light.

BRIEF DESCRIPTION OF THE DRAWINGS

Some embodiments of the present disclosure will be described below as just examples with reference to the accompanying drawings.

EMBODIMENTS

Contents

1. Overall description of extreme ultraviolet light generation system
  1.1 Configuration
  1.2 Operation
2. Terms
3. Description of droplet detection sensor that is example of intra-chamber measurement device
  3.1 Configuration
  3.2 Operation
4. Problem
5. First Embodiment
  5.1 Configuration
  5.2 Operation
  5.3 Effect
6. Second Embodiment
  6.1 Configuration
  6.2 Operation
  6.3 Effect
7. Third Embodiment
  7.1 Configuration
  7.2 Operation
  7.3 Effect
8. Fourth embodiment
  8.1 Configuration
  8.2 Operation
  8.3 Effect
9. Fifth Embodiment
  9.1 Configuration
  9.2 Operation
  9.3 Effect
10. Sixth Embodiment
  10.1 Configuration
  10.2 Operation
  10.3 Effect Hereinafter, embodiments of the present disclosure will be described in detail with reference to the drawings.

The embodiments described below illustrate some examples of the present disclosure, and do not limit the contents of the present disclosure. All of the configurations and the operations described in the embodiments are not always indispensable as configurations and operations of the present disclosure. The same constituent elements are denoted by the same reference signs, and overlapping description is omitted.

Figure 1:
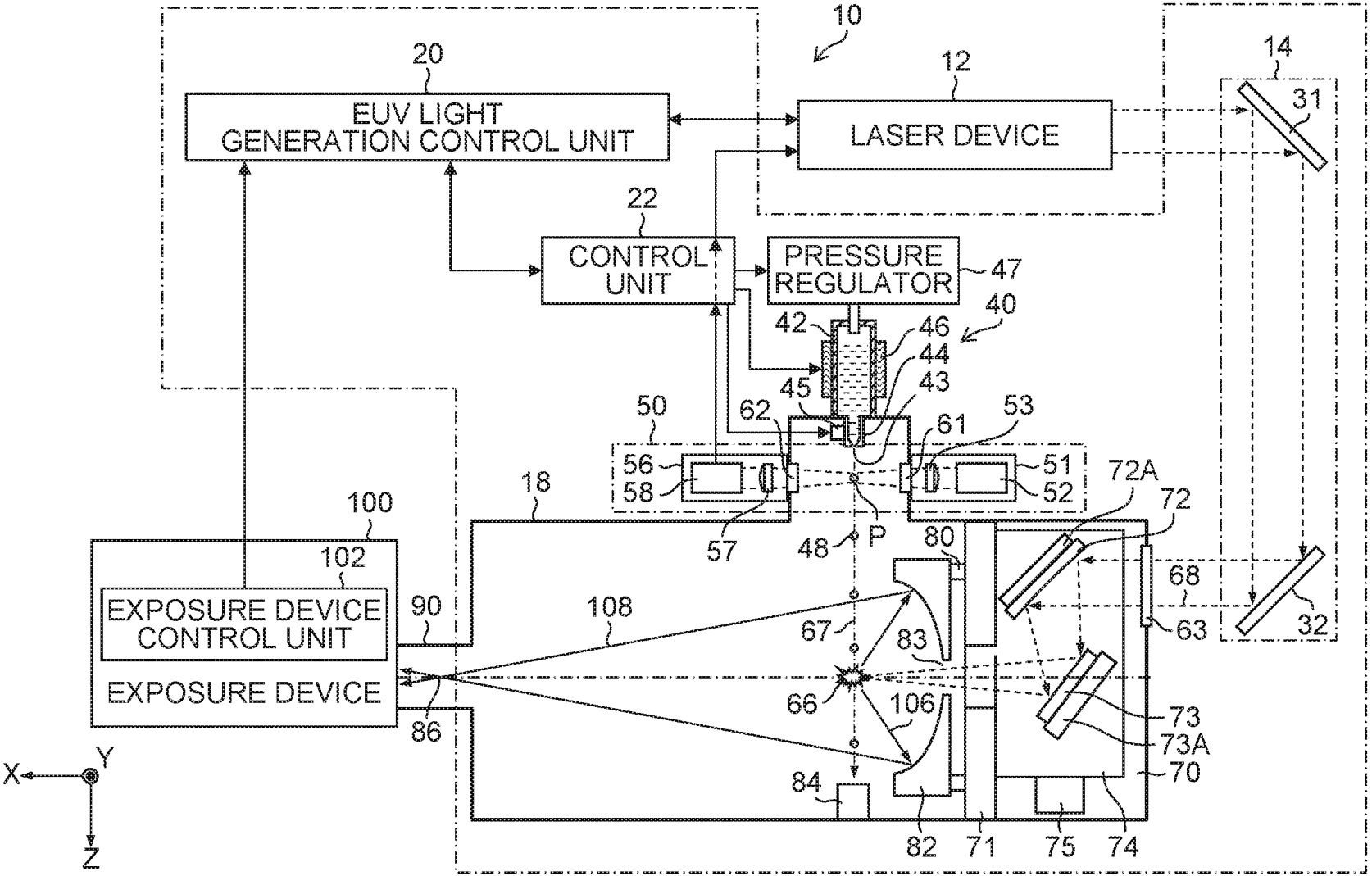
FIG. 1 is a diagram schematically illustrating a configuration of an exemplary LPP type EUV light generation system.

1. Overall Description of Extreme Ultraviolet Light Generation System 1.1 Configuration FIG. 1 schematically illustrates a configuration of an exemplary LPP type EUV light generation system 10. The EUV light generating device 11 may be used together with at least one laser device 12. In the present disclosure, a system including the EUV light generating device 11 and a laser device 12 is referred to as an EUV light generation system 10.

As illustrated in FIG. 1 and described in detail below, the EUV light generating device 11 is configured to include a laser light transmission device 14, a chamber 18, an EUV light generation control unit 20, and a control unit 22.

The laser device 12 may include a master oscillator power amplifier (MOPA) system. The laser device 12 may include a master oscillator not illustrated, an optical isolator not illustrated, and a plurality of $CO_2$ laser amplifiers not illustrated. As the master oscillator, a solid-state laser is adoptable. The wavelength of laser light, output from the master oscillator, is 10.59 μm, for example, and a repetition frequency of pulse oscillation is 100 kHz, for example.

The laser light transmission device 14 includes an optical element for defining a transmission state of the laser light, and an actuator for regulating the position, posture, and the like of the optical element. As an optical element for defining the travel direction of the laser light, the laser light transmission device 14 illustrated in FIG. 1 includes a first high reflective mirror 31 and a second high reflective mirror 32.

The chamber 18 is a sealable container. The chamber 18 may be formed in a hollow spherical shape or a hollow cylindrical shape, for example. The chamber 18 includes a target feeding unit 40 and a droplet detection sensor 50. A wall of the chamber 18 is provided with a first window 61, a second window 62, and a third window 63.

The target feeding unit 40 may feed a target substance into the chamber 18, and the target feeding unit 40 may be mounted so as to penetrate the wall of the chamber 18, for example. The target feeding unit 40 includes a tank 42 for storing a target substance, a nozzle 44 having a nozzle hole 43 for outputting the target substance, a piezoelectric element 45 provided to the nozzle 44, a heater 46 provided to the tank 42, and a pressure regulator 47.

The target feeding unit 40 may output a droplet 48 made of the target substance toward a plasma generation region 66 in the chamber 18. The material of the target substance may include, but not limited to, tin, terbium, gadolinium, lithium, xenon, or a combination of any two or more of them.

The tank 42 may be formed to have a hollow cylindrical shape. The hollow tank 42 contains the target substance therein. At least the inside of the tank 42 is made of a material less likely to react with the target substance. As a material less likely to react with tin that is an exemplary target substance, SiC, $SiO_2$, $Al_2O_3$, molybdenum, tungsten, tantalum, or the like may be used.

The heater 46 is fixed to an outer side face of the tank 42. The heater 46 is connected with a heater power source not illustrated. The heater power source may supply electric power to the heater 46. The heater power source is connected with the control unit 22, and the power supply to the heater 46 is controlled by the control unit 22.

A temperature sensor not illustrated may be fixed to the outer side face of the tank 42. The temperature sensor detects the temperature of the tank 42, and outputs a detection signal to the control unit 22. The control unit 22 may regulate electric power supplied to the heater 46, based on the detection signal output from the temperature sensor.

The pressure regulator 47 is provided to a pipe between an inert gas supply unit not illustrated and the tank 42. The inert gas supply unit may include a gas cylinder filled with inert gas such as helium, argon, or the like. The inert gas supply unit may supply inert gas into the tank 42 via the pressure regulator 47. The pressure regulator 47 is linked to a discharge pump not illustrated. The pressure regulator 47 includes therein a solenoid valve not illustrated for supplying and discharging air, a pressure sensor not illustrated, and the like. The pressure regulator 47 may detect pressure inside the tank 42 with use of the pressure sensor. The pressure regulator 47 may discharge gas in the tank 42 by operating a discharge pump not illustrated.

The pressure regulator 47 is connected with the control unit 22. The pressure regulator 47 outputs a detection signal of the detected pressure to the control unit 22. The control unit 22 supplies, to the pressure regulator 47, a control signal for controlling operation of the pressure regulator 47 such that the pressure in the tank 42 becomes target pressure, based on the detection signal output from the pressure regulator 47.

The pressure regulator 47 can increase or decrease the pressure in the tank 42 by supplying gas into the tank 42 or discharging the gas in the tank 42, based on the control signal from the control unit 22. The pressure in the tank 42 is regulated to the target pressure by the pressure regulator 47.

The nozzle 44 is provided to the bottom face of the cylindrical tank 42. One end of the nozzle 44 in a pipe shape is fixed to the hollow tank 42. The other end thereof has the nozzle hole 43. The tank 42 provided at the one end side of the nozzle 44 is positioned outside the chamber 18, and the nozzle hole 43 provided at the other end side of the nozzle 44 is positioned inside the chamber 18. The insides of the tank 42, the nozzle 44, and the chamber 18 communicate with each other.

On an extended line in the center axis direction of the nozzle 44, the plasma generation region 66 provided in the chamber 18 is positioned. In FIG. 1, a three-dimensional XYZ orthogonal coordinate system is introduced, and the center axis direction of the nozzle 44 is assumed to be a Z axis direction, for convenience of explanation. The direction of deriving EUV light from the chamber 18 toward the exposure device 100 is assumed to be an X axis direction, and a direction perpendicular to the sheet surface of FIG. 1 is assumed to be a Y axis direction.

The nozzle hole 43 is formed in a shape such that a molten target substance is jetted into the chamber 18. As an example of a target substance to be output from the nozzle hole 43, liquid fin may be adopted.

The target feeding unit 40 may form a droplet 48 in a continuous jet method, for example. In the continuous jet method, a standing wave is given to a flow of jetted targets generated by vibration of the nozzle 44, whereby the target is separated cyclically. The separated target may form a free interface by the own surface tension to thereby form a droplet 48.

The piezoelectric element 45 may serve as an element constituting a droplet forming mechanism that applies vibration necessary for forming the droplet 48, to the nozzle 44. The piezoelectric element 45 is fixed to the outer side face of the nozzle 44. The piezoelectric element 45 is connected with the piezoelectric power source not illustrated. The piezoelectric power source supplies electric power to the piezoelectric element 45. The piezoelectric power source is connected with the control unit 22, and power supply to the piezoelectric element 45 is controlled by the control unit 22.

The droplet detection sensor 50 may detect any of, or a plurality of, presence, trajectory, position, and velocity of the droplet 48 output into the chamber 18. The droplet detection sensor 50 may include a light source unit 51 and a light receiving unit 56. The light source unit 51 may include a light source 52 and an illumination optical system 53.

The light source unit 51 is disposed to illuminate the droplet 48 at a predetermined position P on a droplet trajectory 67 between the nozzle 44 of the target feeding unit 40 and the plasma generation region 66. The light source 52 may be a laser light source of monochromatic light or a lamp that emits light of a plurality of wavelengths. The light source 52 may include an optical fiber which is connected with the illumination optical system 53. The illumination optical system 53 includes a condensing lens. The first window 61 may be included in the constituent elements of the illumination optical system 53.

The light receiving unit 56 includes a transfer optical system 57 and an optical sensor 58. The light receiving unit 56 is disposed to receive illumination light output from the light source unit 51. The transfer optical system 57 includes a lens that transfers an image at the predetermined position P of the illumination light from the light source 52, onto an element of the optical sensor 58. The second window 62 may be included in the constituent elements of the transfer optical system 57.

The optical sensor 58 includes one or more light receiving surfaces. The optical sensor 58 may be configured of any of a photodiode, a photodiode array, an avalanche photodiode, a multiplier phototube, a multi-pixel photon counter, an image sensor such as a CCD camera, and an image intensifier. CCD is an abbreviation of "Charge-coupled device". The optical sensor 58 outputs an electric signal corresponding to the light receiving amount.

The light source unit 51 and the light receiving unit 56 may be disposed opposite to each other over a droplet trajectory 67. The droplet trajectory 67 is a travel path of the droplet 48 that is a target output into the chamber 18. The opposing direction of the light source unit 51 and the light receiving unit 56 may be orthogonal to the droplet trajectory 67 or non-orthogonal to the droplet trajectory 67. An optical path in the light source unit 51 and the light receiving unit 56 is covered so as to prevent unexpected reflection of illumination light from being emitted to the outside of the optical path.

The wall of the chamber 18 has a through hole for introducing the pulse laser light 68, output from the laser device 12, into the chamber 18. The through hole is closed with a third window 63. The pulse laser light 68 output from the laser device 12 penetrates the third window 63.

The laser light condensing optical system 70, a first plate 71, an EUV light condensing mirror holder 80, an EUV light condensing mirror 82, and a droplet receiver 84 are disposed in the chamber 18.

The laser light condensing optical system 70 condenses the laser light, made incident on the chamber 18 via the third window 63, in the plasma generation region 66. The laser light condensing optical system 70 includes a high-reflective off-axis paraboloid mirror 72, a high-reflective planar mirror 73, a second plate 74, and a triaxial stage 75. The high-reflective off-axis paraboloid mirror 72 is held by a mirror holder 72A. The mirror holder 72A is fixed to the second plate 74. The high-reflective planar mirror 73 is held by a mirror holder 73A. The mirror holder 73A is fixed to the second plate 74. The triaxial stage 75 is a stage that can move the second plate 74 in triaxial directions of an X axis, a Y axis, and a Z axis orthogonal to each other.

The first plate 71 is a member that is fixed to the inner wall of the chamber 18, and holds the laser light condensing optical system 70 and the EUV light condensing mirror 82. The EUV light condensing mirror 82 is held by the EUV light condensing mirror holder 80. The EUV light condensing mirror holder 80 is fixed to the first plate 71.

The EUV light condensing mirror 82 has a spheroidal reflection surface. The EUV light condensing mirror 82 may have a first focus and a second focus. On the surface of the EUV light condensing mirror 82, a multilayer reflection film in which molybdenum and silicon are alternately layered is formed, for example. The EUV light condensing mirror 82 is disposed such that the first focus thereof is positioned in the plasma generation region 66 and the second focus thereof is positioned at an intermediate focusing point (IF) 86, for example. A center portion of the EUV light condensing mirror 82 is provided with a through hole 83 through which pulse laser light 68 passes.

The droplet receiver 84 is disposed on an extended line in a travel direction of the droplet 48 output from the target feeding unit 40 into the chamber 18. In FIG. 1, the dropping direction of the droplet 48 is a direction parallel to the Z axis, and the droplet receiver 84 is disposed at a position opposite to the target feeding unit 40 in the Z direction.

The chamber 18 is provided with a discharge device not illustrated and a pressure sensor not illustrated. The chamber 18 is connected with a gas supply device not illustrated.

The control unit 22 is connected with each of the EUV light generation control unit 20, the laser device 12, the target feeding unit 40, and the droplet detection sensor 50. The control unit 22 is also connected with a discharge device not illustrated, a pressure sensor, and a gas supply control valve. The control unit 22 controls operation of the target feeding unit 40 in accordance with an instruction from the EUV light generation control unit 20. The control unit 22 also controls output timing of the pulse laser light 68 of the laser device 12 based on a detection signal from the droplet detection sensor 50.

The EUV light generating device 11 also includes a connecting section 90 that allows the inside of the chamber 18 and the inside of an exposure device 100 to communicate with each other. The inside of the connecting section 90 is provided with a wall having an aperture not illustrated. The aperture is positioned at the second focus position of the EUV light condensing mirror 82.

The exposure device 100 includes an exposure device control unit 102 which is connected with the EUV light generation control unit 20.

The EUV light generation control unit 20 presides over the control of the entire EUV light generation system 10. The EUV light generation control unit 20 controls the output cycle of the droplet 48, the velocity of the droplet 48, and the like, for example, based on the detection result of the droplet detection sensor 50. Furthermore, the EUV light generation control unit 20 controls the oscillation timing of the laser device 12, the travel direction of the pulse laser light 68, and the condensing position of the pulse laser light 68, and the like, for example. The aforementioned various types of control are mere examples. Other types of control may be added as required, or part of the control functions may be omitted.

In the present disclosure, controllers such as the EUV light generation control unit 20, the control unit 22, and the exposure device control unit 102 can be realized by a combination of hardware and software of one or a plurality of computers. Software has the same meaning as a program. A programmable controller is included in the concept of computer.

It is also possible to realize functions of a plurality of controllers by one controller. Further, in the present disclosure, the EUV light generation control unit 20, the control unit 22, the exposure device control unit 102, and the like may be connected with each other over a communication network such as a local area network or the Internet. In a distributed computing environment, a program unit may be stored in memory storage devices of both local and remote.

1.2 Operation

Operation of the exemplary LPP type EUV light generation system 10 will be described with reference to FIGS. 1 and 2. The control unit 22 controls discharge by a discharge device not illustrated and gas supply from a gas supply device such that the pressure in the chamber 18 falls within a given range, based on a detection value of a pressure sensor, not illustrated, provided to the chamber 18. The given range of the pressure in the chamber 18 is a value between several pascals [Pa] to several hundreds pascals [Pa], for example.

When the control unit 22 receives a droplet generation signal from the EUV light generation control unit 20, the control unit 22 controls the heater 46 to thereby heat the target substance in the tank 42 up to a predetermined temperature equal to or higher than the melting point of the target substance. When the target substance is tin, the control unit 22 controls the heater 46 to thereby heat the tin in the tank 42 up to a predetermined temperature equal to or higher than the melting point of tin to thereby control the temperature of the tin in the tank 42. The predetermined temperature may be in a range from 250° C. to 290° C. The melting point of tin is 232° C.

The control unit 22 also controls the pressure regulator 47 such that the pressure in the tank 42 becomes a pressure that can output a jet of liquid tin from the nozzle hole 43 at a predetermined velocity.

Next, the control unit 22 transmits a signal to supply voltage of a given waveform to the piezoelectric element 45 so as to generate the droplet 48. The piezoelectric element 45 oscillates when the voltage of the given waveform is supplied to the piezoelectric element 45. As a result, regular disturbance is given to the jets of molten tin output from the nozzle hole 43, by the vibration of the nozzle hole 43. Thereby, the molten tin in the form of jet is divided into the droplets 48, and the droplets 48 having almost the same volume can be generated cyclically.

The illumination light output from the light source unit 51 of the droplet detection sensor 50 passes through the predetermined position P on the droplet trajectory 67 and is received by the light receiving unit 56.

Figure 2:
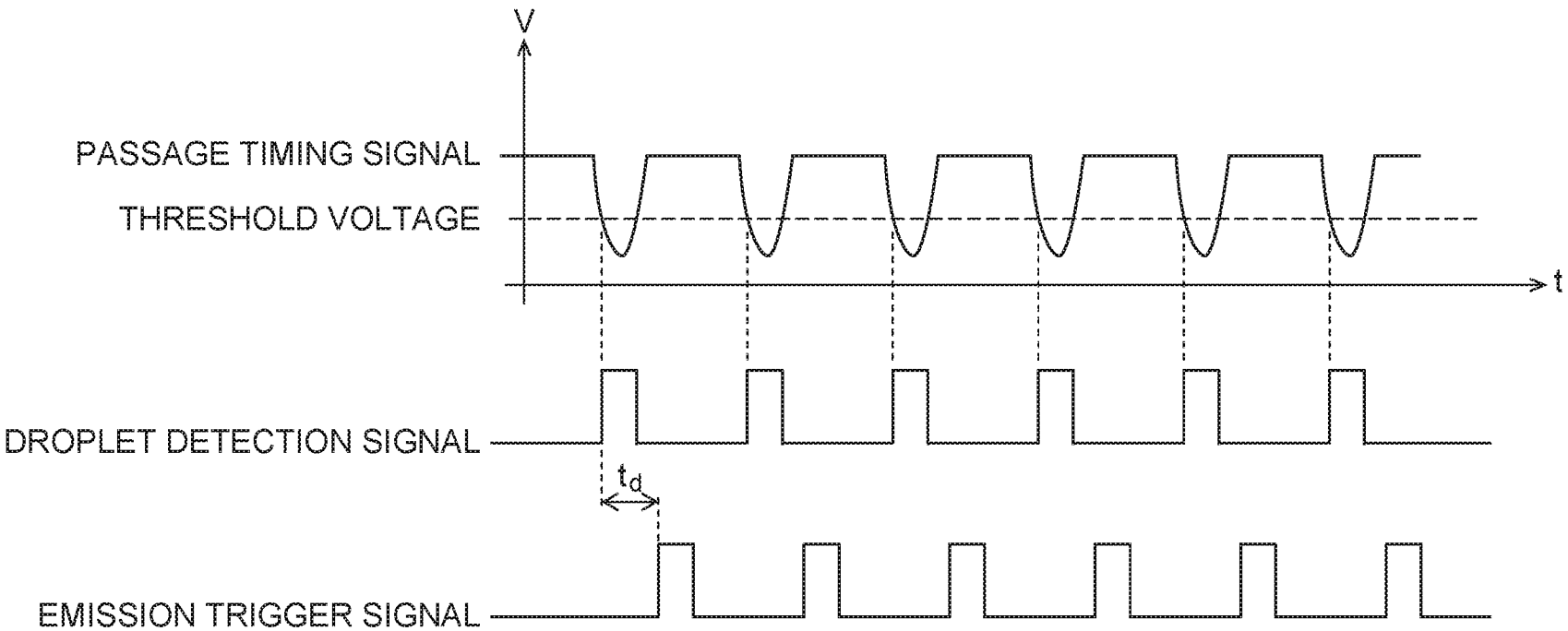
FIG. 2 is a timing chart of a droplet passage timing signal, a droplet detection signal, and a light emission trigger signal.

FIG. 2 is a timing chart of a droplet passage timing signal, a droplet detection signal, and a light emission trigger signal. In FIG. 2, the horizontal axis represents time, and the vertical axis of each signal represents voltage. The passage timing signal is a voltage signal output from the optical sensor 58 of the light receiving unit 56. In synchronization with the droplet 48 passing through the position P, the intensity of light received by the light receiving unit 56 drops. A change in the light intensity is detected by the optical sensor 58. The optical sensor 58 outputs the detection result as a passage timing signal, to the control unit 22.

When the pulse laser light 68 is radiated to the droplet 48, the control unit 22 generates a droplet detection signal at timing when the passage timing signal becomes lower than the threshold voltage. The control unit 22 outputs, to the laser device 12, a light emission trigger signal delayed by a given time from the droplet detection signal. A delay time $t_d$ is set such that the pulse laser light 68 is radiated to the droplet 48 when the droplet 48 reaches the plasma generation region 66.

When the light emission trigger signal is input to the laser device 12, the pulse laser light 68 is output from the laser device 12. The laser device 12 outputs the pulse laser light 68 in synchronization with the light emission trigger signal.

The power of the laser light output from the laser device 12 reaches several kW to several tens kW. The pulse laser light 68, output from the laser device 12, passes through the third window 63 via the laser light transmission device 14, and is input to the chamber 18.

The pulse laser light 68 is condensed by the laser light condensing optical system 70, and is radiated to the droplet 48 that has reached the plasma generation region 66.

The droplet 48 is irradiated with at least one pulse included in the pulse laser light 68. The droplet 48 irradiated with the pulse laser light 68 is made into plasma, and radiation light 106 is emitted from the plasma. The EUV light 108 included in the radiation light 106 is selectively reflected by the EUV light condensing mirror 82. The EUV light 108 reflected by the EUV light condensing mirror 82 is condensed at the intermediate focusing point 86 and is output to the exposure device 100. One droplet 48 may be irradiated with a plurality of pulses included in the pulse laser light 68.

The droplet receiver 84 recovers the droplet 48 not irradiated with the pulse laser light 68 and passing through the plasma generation region 66, or part of the droplet not dispersed even with irradiation of the pulse laser light 68.

2. Terms

"Target" is an object to be irradiated with laser light introduced to the chamber. The target irradiated with laser light is made into plasma and emits EUV light. A droplet made of a liquid target substance is a form of a target. The target serves as the source of plasma.

"Plasma light" is radiation light emitted from plasma. The radiation light emitted from the target made into plasma is a form of plasma light. The radiation light includes EUV light. The plasma that generates EUV light is referred to as "EUV light generation plasma".

The expression "EUV light" is an abbreviation of "extreme ultraviolet light".

"$CO_2$" represents carbon dioxide.

A term "optical element" has the same meaning as an optical component or an optical member.

A term "chamber device" means a device including a chamber inside which plasma is generated.

A term "intra-chamber measurement device" means a device that acquires information of a physical amount of something that reflects the internal state of the chamber. The intra-chamber measurement device of the present disclosure includes a light source that emits light used for measurement, and the light emitted from the light source enters the chamber. The intra-chamber measurement device may be included in the configuration of a chamber device. The intra-chamber measurement device may simply be referred to as a "measurement device".

"Measurement light" means light that is emitted from a light source and is used for measurement. For example, when illumination light is emitted to a droplet fed into the chamber, illumination light passing around the droplet or illumination light scattered by the droplet corresponds to measurement light.

3. Description of Droplet Detection Sensor that is Example of Intra-Chamber Measurement Device

3.1 Configuration

Figure 3:
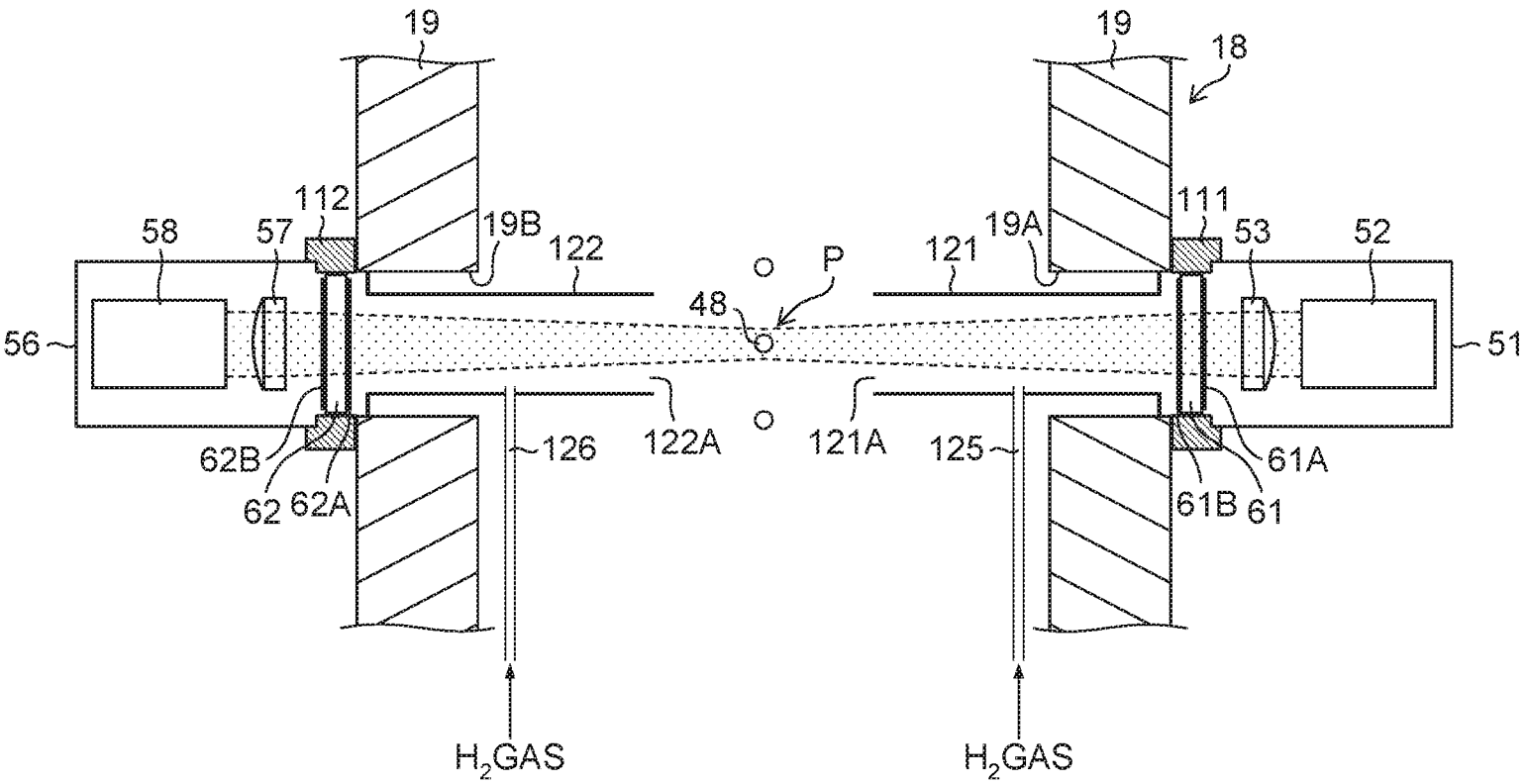
FIG. 3 is a diagram illustrating an exemplary configuration of a droplet detection sensor that is an example of an intra-chamber measurement device.

FIG. 3 is a diagram illustrating an exemplary configuration of a droplet detection sensor 50 that is an example of an intra-chamber measurement device. The droplet detection sensor 50 includes a light source 52 and an illumination optical system 53 that emit light, and an optical sensor 58 and a transfer optical system 57 that receive light.

The inside of the chamber 18 is in a decompression environment. The light source 52 and the optical sensor 58 are disposed under an atmospheric environment outside the chamber 18. On the wall 19 of the chamber 18, the first window 61 and the second window 62 that transmit light are disposed as partition walls to maintain the pressure difference between the inside and the outside of the chamber 18, while allowing the measurement light to enter the chamber 18.

The first window 61 is held by a first window holder 111, and is disposed to close a first through hole 19A penetrating the wall 19 of the chamber 18. The second window 62 is held by a second window holder 112, and is disposed to close a second through hole 19B penetrating the wall 19 of the chamber 18.

The chamber 18 is also provided with a first cover 121 and a second cover 122 that cover an optical path of the measurement light passing through the inside of the chamber 18. The first cover 121 is a shroud that covers an optical path of measurement light traveling from the first window 61 toward the predetermined position P on the trajectory of the droplet 48. The second cover 122 is a shroud that covers an optical path of the measurement light having passed through the predetermined position P and traveling toward the second window 62. Each of the first cover 121 and the second cover 122 has a hollow cylindrical shape.

The first cover 121 is connected with a gas pipe 125, and the second cover 122 is connected with a gas pipe 126. The gas pipes 125 and 126 are connected with a gas supply device not illustrated. The gas supply device is a gas supply source that supplies gas to the gas pipes 125 and 126. The gas supply device may be a hydrogen gas supply device that supplies hydrogen gas, for example. Hydrogen gas is an example of purge gas. Purge gas is not limited to hydrogen gas. It may be gas containing hydrogen. It is preferable that purge gas is gas containing a component that can react with the material of the target substance and generate gas that is a compound. The type of purge gas is selected according to the material of the target substance.

3.2 Operation

The light output from the light source 52 is transformed, by the illumination optical system 53, to be in a light shape appropriate for intended measurement such as light condensing or magnification and passes through the first window 61, and is made incident in the chamber 18. The first window 61 functions as an incidence window for introducing the measurement light into the chamber 18.

The light passing through the first window 61 and made incident in the chamber 18 passes through the second window 62 and enters the transfer optical system 57. The light is processed to have a given light shape by the transfer optical system 57, and is received by the optical sensor 58. The second window 62 functions as an emission window for emitting the measurement light, passing through the chamber 18, to the outside of the chamber 18.

The intra-chamber measurement device is not limited to the droplet detection sensor 50 illustrated as an example in FIG. 3. A droplet position sensor or a target size sensor may be used.

A droplet position sensor is a sensor that detects a position of the droplet 48 output from the nozzle hole 43 in an X direction, a Y direction, a Z direction, or two or more directions thereof. A target size sensor is a sensor that detects the size of a target to be irradiated with the pulse laser light 68. The droplet detection sensor 50, the droplet position sensor, and the target size sensor have similar basic configurations. However, specific forms of the light sources and the light receiving units thereof are configured as described below.

The light source 52 of the droplet detection sensor 50 is a continuous-wave (CW) laser light source, for example. CW is an abbreviation of "continuous wave". The light receiving unit 56 of the droplet detection sensor 50 includes a photodiode array or a photodiode as an optical sensor 58.

A light source of a droplet position sensor is a CW laser light source, for example. A light receiving unit of the droplet position sensor includes an image sensor such as a CCD camera as an optical sensor, for example.

A light source of the target size sensor is a high-luminance pulse light source such as a flash lamp that is synchronized with the imaging timing, for example. A light receiving unit of the target size sensor includes an image sensor such as a CCD camera as an optical sensor, and a high-speed shutter that is synchronized with the imaging timing, for example.

The illumination optical system 53, the transfer optical system 57, and the like are configured as appropriate in accordance with the arranging position, magnification, viewing angle, and the like of the measurement device.

The hydrogen gas supplied from the gas pipe 125 into the first cover 121 is ejected from an opening 121A of the first cover 121. The hydrogen gas supplied from the gas pipe 126 into the second cover 122 is ejected from an opening 122A of the second cover 122.

In the case where the tin droplet 48 is irradiated with the pulse laser light 68 in the plasma generation region 66 described in FIG. 1, Sn debris may be generated along with generation of plasma and dispersed in the chamber 18. In that case, Sn debris means Sn particles. The dispersed Sn debris may reach the opening 121A of the first cover 121 and the opening 122A of the second cover 122.

From each of the opening 121A of the first cover 121 and the opening 122A of the second cover 122, hydrogen gas is ejected. Accordingly, it is possible to suppress arrival of Sn debris to the first window 61 and the second window 62.

Further, by supplying gas including hydrogen to the surroundings of the first window 61 and the second window 62, Sn debris deposited on the first window 61 and the second window 62 and the hydrogen react with each other to thereby generate stannane gas ($SnH_4$). The stannane gas is discharged to the outside of the chamber 18 by a discharge device not illustrated. Thereby, deposition of Sn debris on the first window 61 and the second window 62 is suppressed.

When Sn debris enters, the possibility that the hydrogen and Sn react with each other becomes higher, as the inner diameter of the cylindrical portion of each of the first cover 121 and the second cover 122 is smaller and the length of the cylindrical portion is longer. Therefore, it is possible to make the Sn debris into stannane gas more reliably.

Respective embodiments described below are applicable to any intra-chamber measurement device disposed in the chamber 18.

4. Problem

Figure 4:
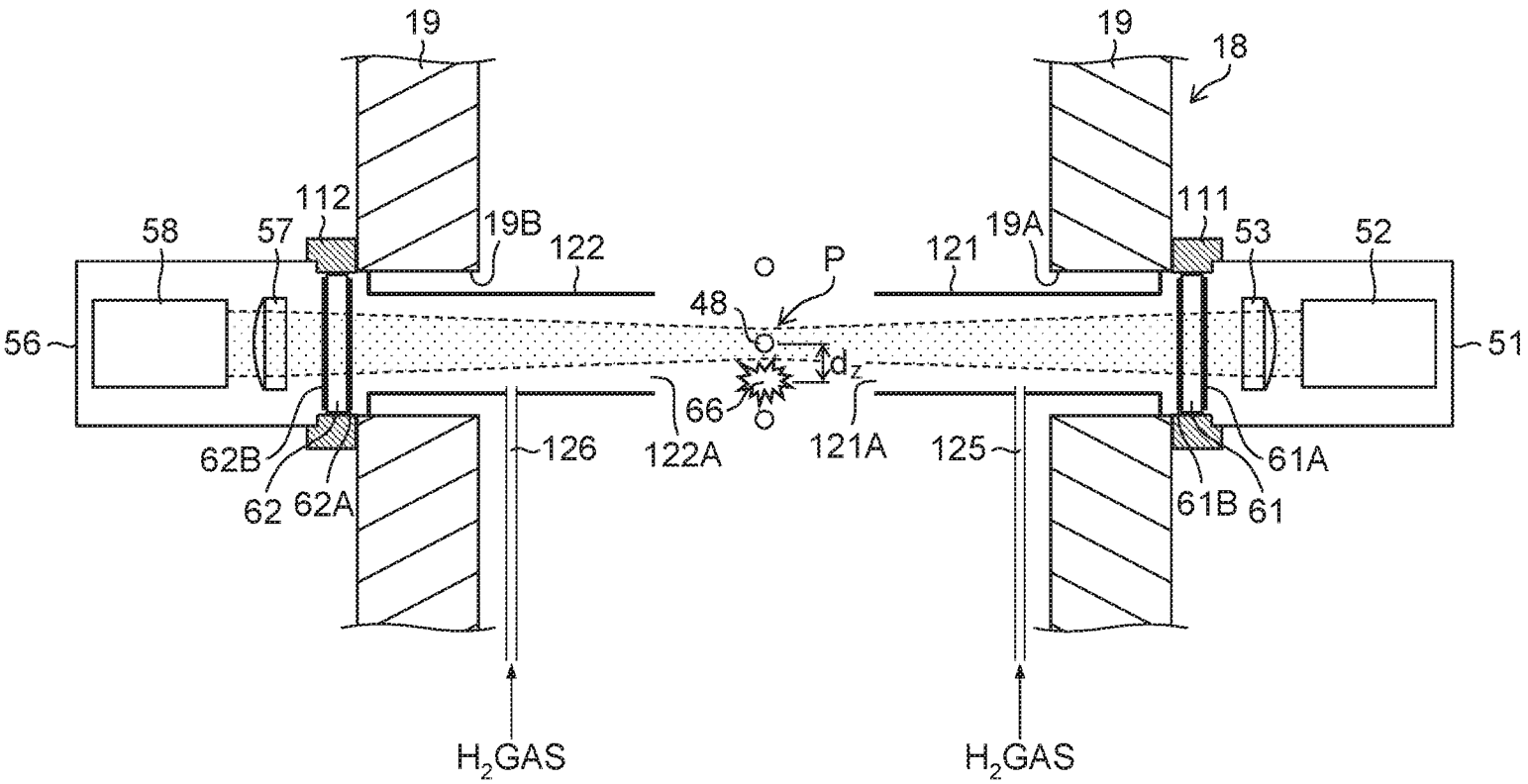
FIG. 4 is a diagram illustrating an exemplary configuration of a droplet detection sensor.

FIG. 4 illustrates an exemplary configuration of the droplet detection sensor 50 that is an example of an intra-chamber measurement device, in which the plasma generation region 66 is additionally illustrated to the configuration illustrated in FIG. 3. The droplet 48 may travel at a slight angle relative to the droplet trajectory 67. Accordingly, by reducing a distance $d_Z$ between the predetermined position P that is a measurement point of the droplet 48 by the droplet detection sensor 50 and the plasma generation region 66, it is possible to reduce an error in the laser irradiation timing on the basis of detection of a droplet. For example, the distance $d_Z$ between the predetermined position P and the plasma generation region 66 is designed within a range from about 2 mm to about 10 mm.

In FIG. 1, the distance between the position P and the plasma generation region 66 is illustrated to be changed significantly from the actual scale ratio, for the sake of convenience. However, in the actual device, the distance $d_Z$ between the position P and the plasma generation region 66 is close to each other, and plasma light generated in the plasma generation region 66 may directly reach the first window 61 and the second window 62, as illustrated in FIG. 4. The distance $d_Z$ is smaller than a half of the inner diameter of the first cover 121 and the second cover 122. This means that the respective surfaces, facing the inside of the chamber 18, of the first window 61 and the second window 62 are directly exposed to the plasma light.

Both surfaces of the first window 61 illustrated in FIGS. 3 and 4 are coated with anti-reflection films 61A and 61B. Both surfaces of the second window 62 are coated with anti-reflection films 62A and 62B. The anti-reflection film is referred to as an AR film. AR is an abbreviation of "anti-reflection". The anti-reflection films 61A, 61B, 62A, and 62B are magnesium fluoride ($MgF_2$) films, for example.

An object of applying anti-reflection films to the first window 61 and the second window 62 is to increase the transmittance of light for measurement to thereby improve the detection performance of the measurement device. Another object of applying anti-reflection films to the first window 61 and the second window 62 is to prevent unstable operation of the device caused by reflected light from at least one of the first window 61 and the second window 62 returning to the light source 52, and also prevent mixing of measurement noise such as multiple reflection or interference.

However, there are problems as described below.

[Problem 1] The anti-reflection film deteriorates, which lowers the light transmittance in turn.

[Problem 2] Deterioration state of the anti-reflection film varies as time passes, whereby performance of the measurement device varies.

It is assumed that a cause of problems 1 and 2 is that the anti-reflection film is exposed to light having various wavelengths, in particular, ultraviolet to X-ray light, from plasma for EUV generation, so that the anti-reflection film deteriorates. Deterioration in the anti-reflection film includes variation in the film thickness of the anti-reflection film or variation in the composition of the anti-reflection film, or both of them.

5. First Embodiment

5.1 Configuration

Figure 5:
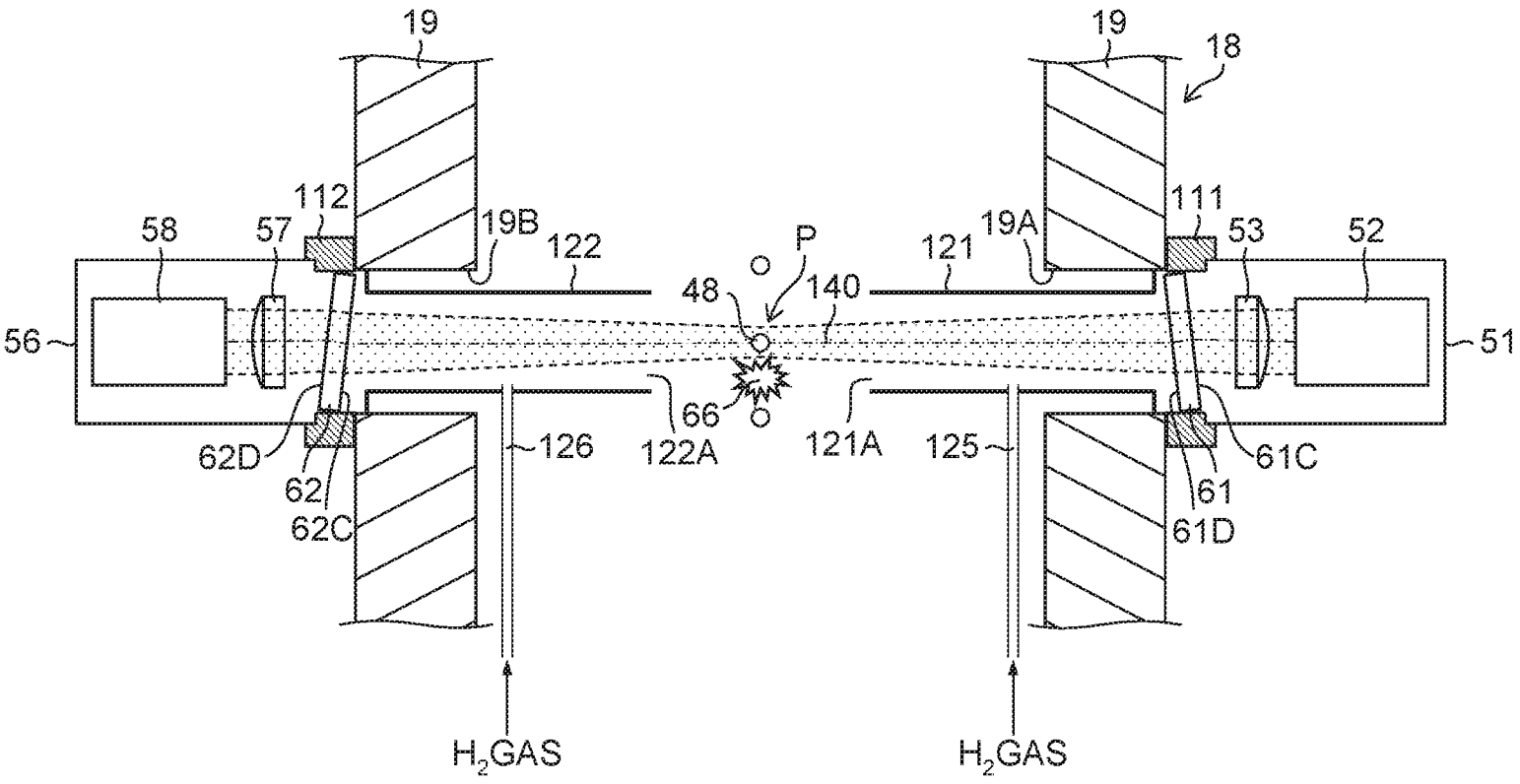
FIG. 5 is a diagram illustrating a configuration of a droplet detection sensor provided to a chamber device according to a first embodiment.

FIG. 5 is a diagram illustrating a configuration of a droplet detection sensor provided to a chamber device according to a first embodiment. Regarding the first embodiment illustrated in FIG. 5, a difference from the configuration described in FIG. 4 will be described. The configuration illustrated in FIG. 5 is adoptable in place of the configuration described in FIG. 4.

In a droplet detection sensor 50 according to the first embodiment, both surfaces of each of the first window 61 and the second window 62 are not coated with an anti-reflection film. This means that the first window 61 is a non-coated window, and each of a light incidence surface 61C and a light emission surface 61D of the first window 61 is not coated with an anti-reflection film. The light incidence surface 61C of the first window 61 is a window surface facing the outside of the chamber 18. The light emitted from the light source 52 is made incident on the light incidence surface 61C of the first window 61. The light emission surface 61D of the first window 61 is a window surface facing the inside of the chamber 18. The light passing through the first window 61 is emitted from the light emission surface 61D into the chamber 18. The light emission surface 61D of the first window 61 is exposed to the plasma light generated in the plasma generation region 66.

The second window 62 is also a non-coated window, and each of a light incidence surface 62C and a light emission surface 62D of the second window 62 is not coated with an anti-reflection film. The light incidence surface 62C of the second window 62 is a window surface facing the inside of the chamber 18. The light incidence surface 62C is exposed to the plasma light generated in the plasma generation region 66. The measurement light passing through the inside of the chamber 18 is made incident on the light incidence surface 62C of the second window 62. The light emission surface 62D is a window surface facing the outside of the chamber 18. The measurement light passing through the second window 62 is emitted from the light emission surface 62D to the outside of the chamber 18.

The first window 61 is a flat window configured of a parallel plane substrate in which the light incidence surface 61C and the light emission surface 61D are parallel to each other. The second window 62 is also a flat window configured of a parallel plane substrate in which the light incidence surface 62C and the light emission surface 62D are parallel to each other. As illustrated in FIG. 5, each of the first window 61 and the second window 62 is disposed on the wall 19 of the chamber 18 in a state where the window surface is inclined at a non-perpendicular angle against an optical axis 140 of the measurement light emitted from the light source 52. The inclination angle of each of the first window 61 and the second window 62 may be set to an appropriate angle of a level that reflected light at each window surface does not enter the light source 52 and the optical sensor 58. For example, the inclination angle of each of the first window 61 and the second window 62 may be an angle inclined by about one degree to two degrees with reference to the perpendicularly disposed state relative to the optical axis 140. In the example of FIG. 5, the light emission surface 61D of the first window 61 and the light incidence surface 62C of the second window 62 are inclined downward, and the first window 61 and the second window 62 are disposed on the wall 19 of the chamber 18 in a non-parallel state.

While FIG. 5 illustrates an example in which the first window 61 and the second window 62 are respectively turned about a turning axis parallel to the Y axis whereby the window surfaces are inclined, the turning axis and the inclined directions for giving inclination to the window surfaces are not limited to those of the example of FIG. 5. The inclination angle of the first window 61 and the inclination angle of the second window 62 may be the same or different. The inclination angle of the first window 61 and the inclination angle of the second window 62 may be in the same direction or different directions.

It is desirable that the base material of each of the first window 61 and the second window 62 is synthetic quartz. The base material of each of the first window 61 and the second window 62 may be sapphire. The base material of the first window 61 and the base material of the second window 62 may be the same or different.

5.2 Operation

Operation of the droplet detection sensor 50 according to the first embodiment illustrated in FIG. 5 is similar to the operation of the droplet detection sensor described in FIG. 3.

5.3 Effect

According to the first embodiment, as the window surfaces of each of the first window 61 and the second window 62 are not coated with an anti-reflection film, deterioration of an anti-reflection film due to EUV light generation plasma will never occur, whereby time deterioration and counting variation in the measurement device are suppressed.

In the first embodiment, the first window 61 and the second window 62 do not have anti-reflection films. Accordingly, light reflection at the window surfaces increases, compared with the configuration having anti-reflection films. However, the first window 61 and the second window 62 are inclined, with respect to the optical axis 140 of the light source 52, at a non-perpendicular angle of a level that reflected light at each window surface does not enter the light source 52 and the optical sensor 58. Accordingly, an adverse effect of the reflected light on the light source 52 and the measurement at the window surface is prevented.

The first window 61 corresponds to a form of an incidence window. The light incidence surface 61C of the first window 61 corresponds to a form of a "first surface". The light emission surface 61D of the first window 61 corresponds to a form of a "second surface". The second window 62 corresponds to a form of an emission window. The light incidence surface 62C of the second window 62 corresponds to a form of a "third surface". The light emission surface 62D of the second window 62 corresponds to a form of a "fourth surface". The gas pipe 125 is a pipe for supplying hydrogen gas to the light emission surface 61D side of the first window 61, and corresponds to a form of a "gas supply path". A third window 63 corresponds to a form of a "laser light introduction window.

6. Second Embodiment 6.1 Configuration

Figure 6:
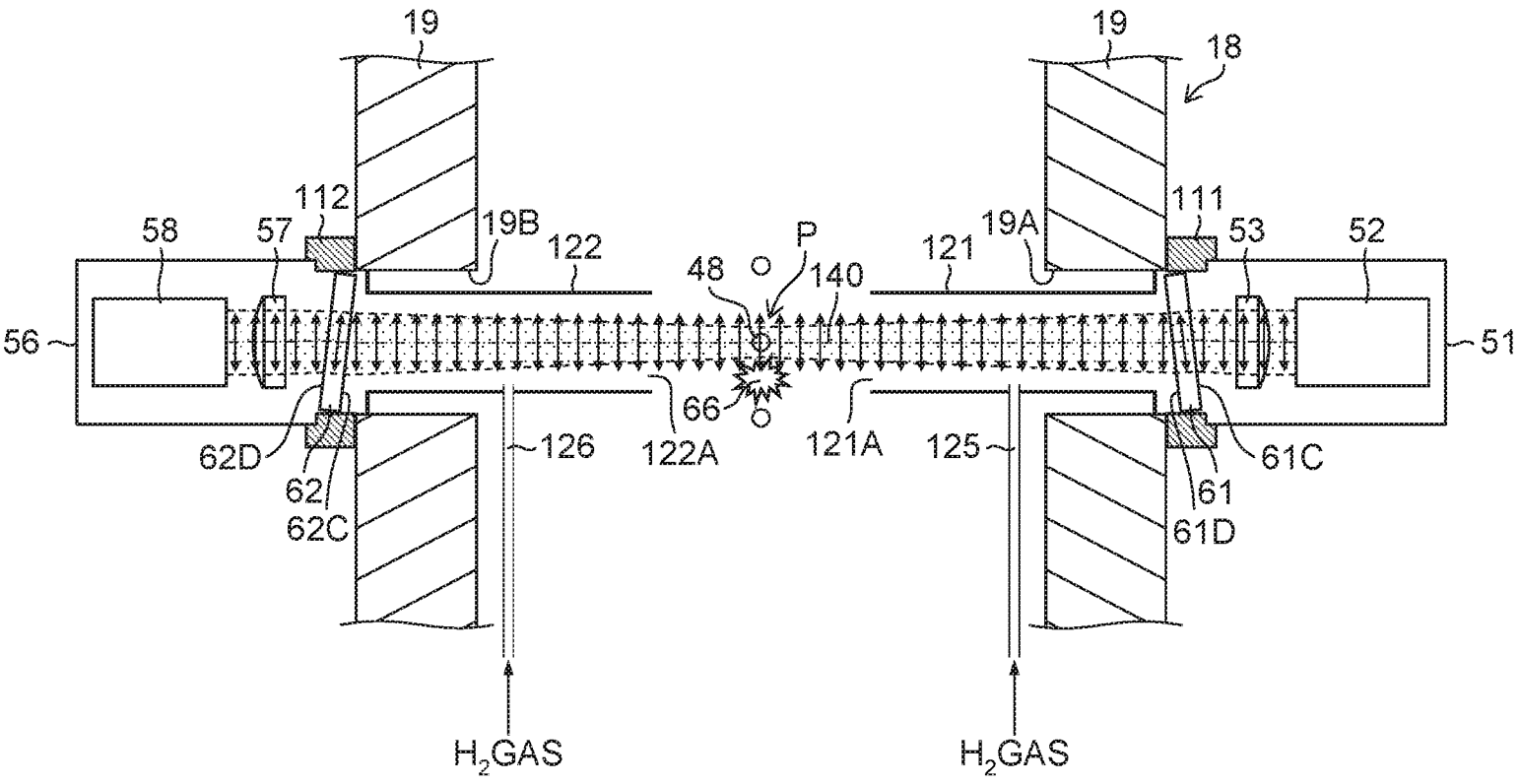
FIG. 6 is a diagram illustrating a configuration of a droplet detection sensor provided to a chamber device according to a second embodiment.

FIG. 6 is a diagram illustrating a configuration of a droplet detection sensor provided to a chamber device according to a second embodiment. Regarding the second embodiment illustrated in FIG. 6, a difference from the configuration described in FIG. 5 will be described. The configuration illustrated in FIG. 6 is adoptable in place of the configuration described in FIG. 5.

In the second embodiment, the inclination angle of each of the first window 61 and the second window 62 is a Brewster's angle relative to the optical axis 140 of the measurement light from the light source 52. The Brewster's angle $\theta_B$ of visible light is an angle satisfying $\tan \theta_B = n_2/n_1$. Here, $\theta_B$ represents an angle defined by the normal line of a light incidence surface and an incident ray, $n_1$ represents a refractive index of an incident side material, $n_2$ represents a refractive index of a transmission side material. For example, the Brewster's angle when light is made incident on a glass from the atmospheric air is 56 degrees. As the refractive index has wavelength dependency, the inclination angle of each of the first window 61 and the second window 62 according to the second embodiment is set to the Brewster's angle of the output wavelength of the light source 52.

In FIG. 6, bidirectional arrows shown in the light flux of the measurement light represent a polarization direction of p-polarized light.

6.2 Operation

Operation of the droplet detection sensor 50 according to the second embodiment illustrated in FIG. 6 is similar to the operation of the droplet detection sensor described in FIG. 3.

6.3 Effect

The window surfaces of the first window 61 and the second window 62 according to the second embodiment do not have anti-reflection films. As such, there is a risk that light reflection at the window surfaces may be increased, the measurement light may be attenuated, and the measurement performance may deteriorate, compared with the configuration having anti-reflection films. As such, in the second embodiment, by setting the inclination angle of the first window 61 and the second window 62 to the Brewster's angle, light reflection at the window surfaces is minimized. Thereby, it is possible to minimize a loss of measurement light on the window surfaces, whereby deterioration of the measurement performance can be suppressed.

Further, the light emission surface 61D of the first window 61 and the light incidence surface 62C of the second window 62, facing the inside of the chamber 18, are inclined downward, that is, in the gravity direction. Therefore, deposition of foreign articles such as Sn debris on the light emission surface 61D and the light incidence surface 62C is further suppressed.

7. Third Embodiment 7.1 Configuration

Figure 7:
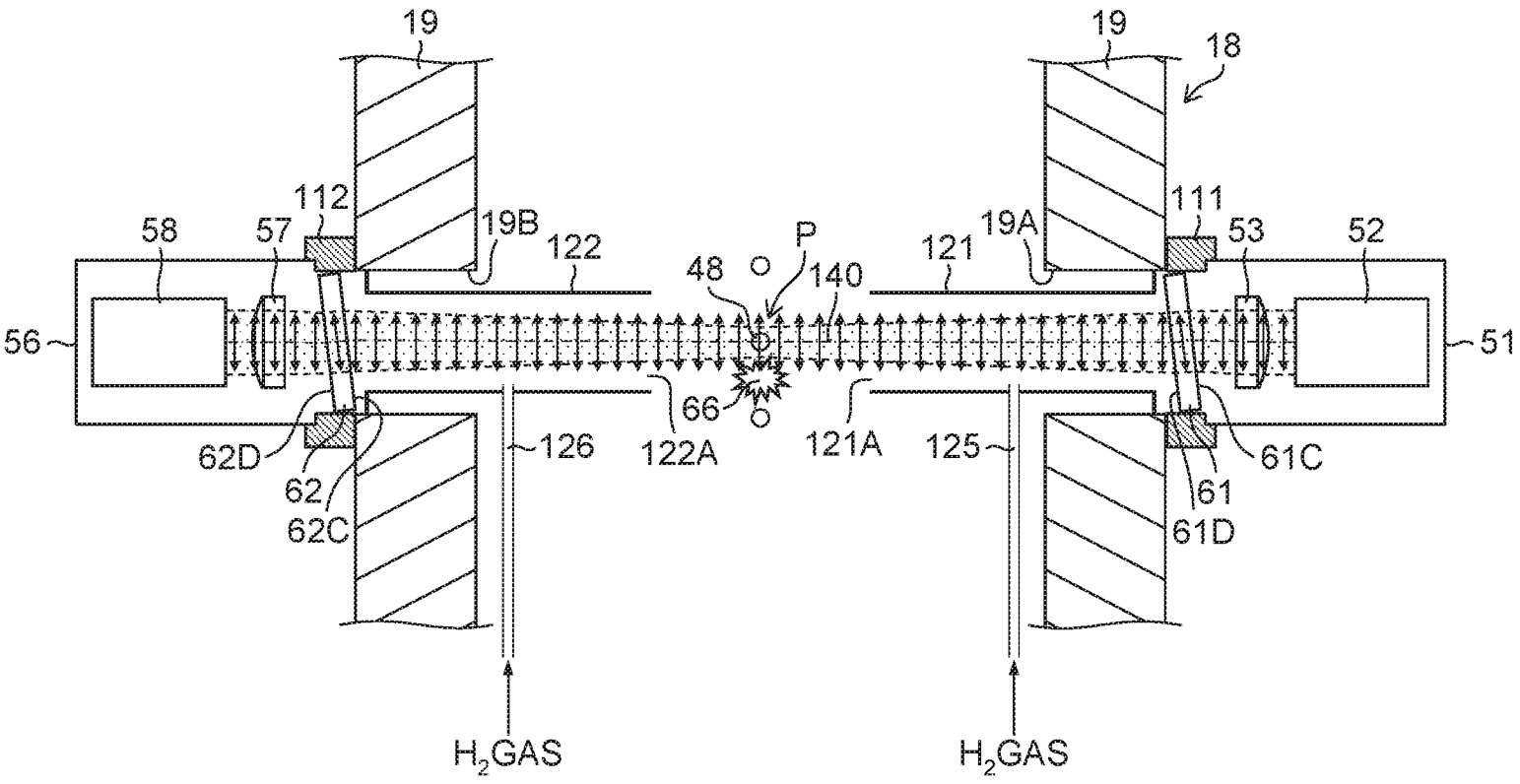
FIG. 7 is a diagram illustrating a configuration of a droplet detection sensor provided to a chamber device according to a third embodiment.

FIG. 7 is a diagram illustrating a configuration of a droplet detection sensor provided to a chamber device according to a third embodiment. Regarding the third embodiment illustrated in FIG. 7, a difference from the configuration described in FIG. 4 will be described. The configuration illustrated in FIG. 7 is adoptable in place of the configuration described in FIG. 4.

In the third embodiment, the inclination angle of each of the first window 61 and the second window 62 is a Brewster's angle relative to the optical axis 140 of the light source 52. The first window 61 and the second window 62 are arranged in parallel.

Further, as the light source 52, the light source 52 that outputs light having a large amount of p-polarized components, to the light incidence surface 61C of the first window 61 disposed at the Brewster's angle, is used. "Having a large amount of p-polarized components" means that a relatively largest amount of p-polarized components are contained in the polarized components of the light emitted from the light source 52.

7.2 Operation

Operation of the droplet detection sensor 50 according to the third embodiment illustrated in FIG. 7 is similar to the operation of the droplet detection sensor described in FIG. 3.

7.3 Effect

The light of the p-polarized component emitted from the light source 52 passes through the first window 61 and the second window 62 disposed at the Brewster's angle of inclination, with little loss. Accordingly, it is possible to further reduce a loss of measurement light in the first window 61 and the second window 62. Moreover, as the first window 61 and the second window 62 are arranged in parallel, it is easier to perform an optical path design and component processing, and it is also easier to regulate the optical path, compared with the case of non-parallel arrangement.

8. Fourth Embodiment 8.1 Configuration

Figure 8:
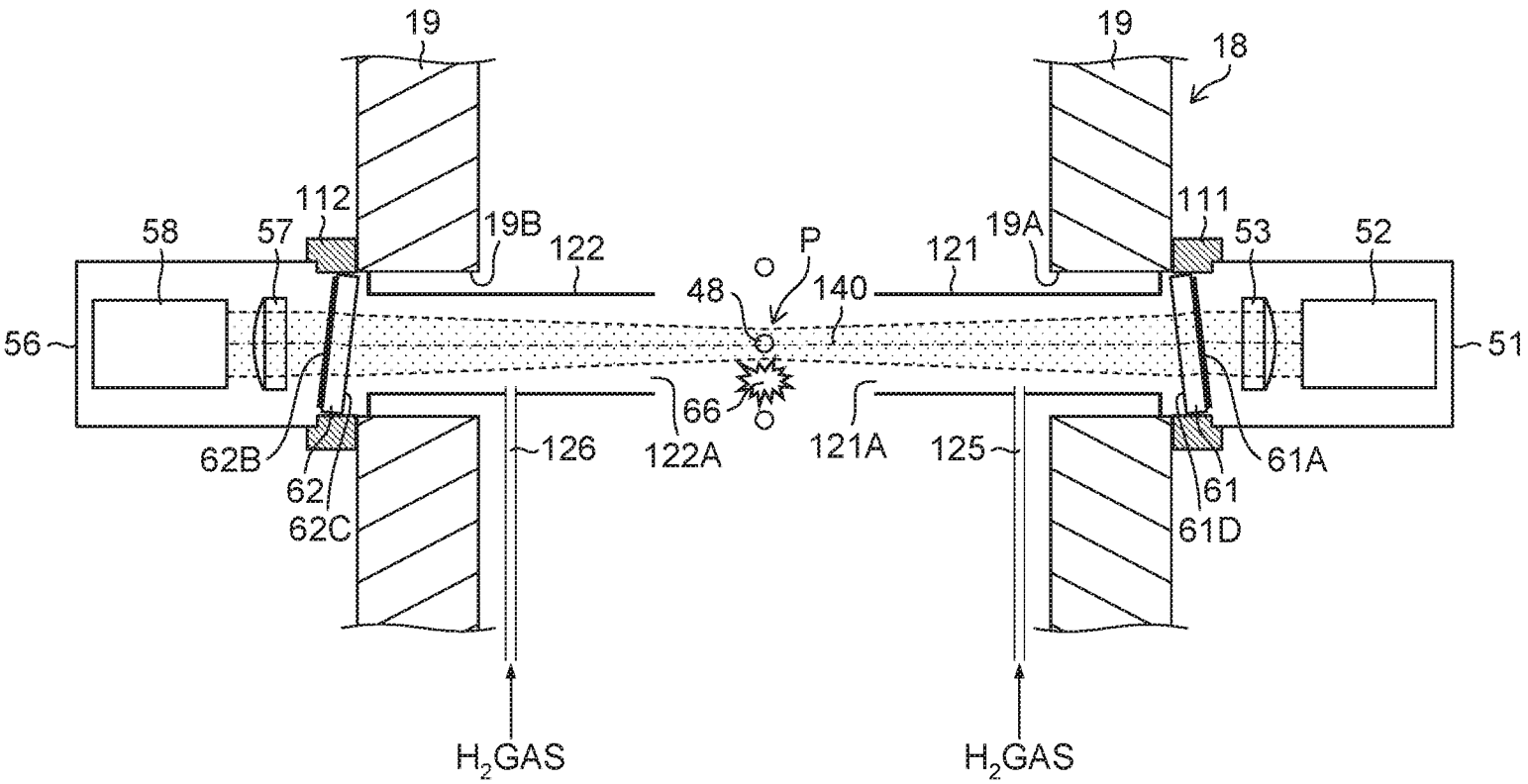
FIG. 8 is a diagram illustrating a configuration of a droplet detection sensor provided to a chamber device according to a fourth embodiment.

FIG. 8 is a diagram illustrating a configuration of a droplet detection sensor provided to a chamber device according to a fourth embodiment. Regarding the fourth embodiment illustrated in FIG. 8, a difference from the configuration described in FIG. 5 will be described. The configuration illustrated in FIG. 8 is adoptable in place of the configuration described in FIG. 5.

Decompression side surfaces of the first window 61 and the second window 62 have no anti-reflection film. Meanwhile, atmospheric side surfaces of the first window 61 and the second window 62 have anti-reflection films 61A and 62B, respectively. This means that the atmospheric side surface of the first window 61 has the anti-reflection film 61A and the light emission surface 61D that is the decompression side surface is a non-coated surface on which anti-reflection film is not coated. The light incidence surface 62C that is the decompression side surface of the second window 62 is a non-coated surface, and the atmospheric side surface of the second window 62 has the anti-reflection film 62B. The material of the anti-reflection films 61A and 62B may be $MgF_2$, for example.

Each of the first window 61 and the second window 62 is inclined at a non-perpendicular angle, against the optical axis 140 of the light source 52. It is only necessary that the inclination angle is an angle at which reflected light from the window surface does not enter the light source 52 or the optical sensor 58 of the light receiving unit 56.

8.2 Operation

Operation of the droplet detection sensor 50 according to the fourth embodiment illustrated in FIG. 8 is similar to the operation of the droplet detection sensor described in FIG. 3.

8.3 Effect

Damages on the anti-reflection films caused by EUV light generation plasma, of both-side AR coated windows illustrated in FIGS. 3 and 4, are larger on the decompression side and smaller on the atmospheric side. According to the configuration illustrated in FIG. 8, by adopting the first window 61 and the second window 62 having one-side AR coating in which decompression side has no anti-reflection films, time degradation can be suppressed to a low level. Further, as the anti-reflection films 61A and 629 are provided to the atmospheric side of the respective windows, a drop of window transmittance of measurement light is smaller compared with that of the configuration having a both-side non-coated window. Accordingly, in the fourth embodiment illustrated in FIG. 8, a drop of light amount of measurement light can be suppressed compared with that of the first embodiment illustrated in FIG. 5.

9. Fifth Embodiment 9.1 Configuration

Figure 9:
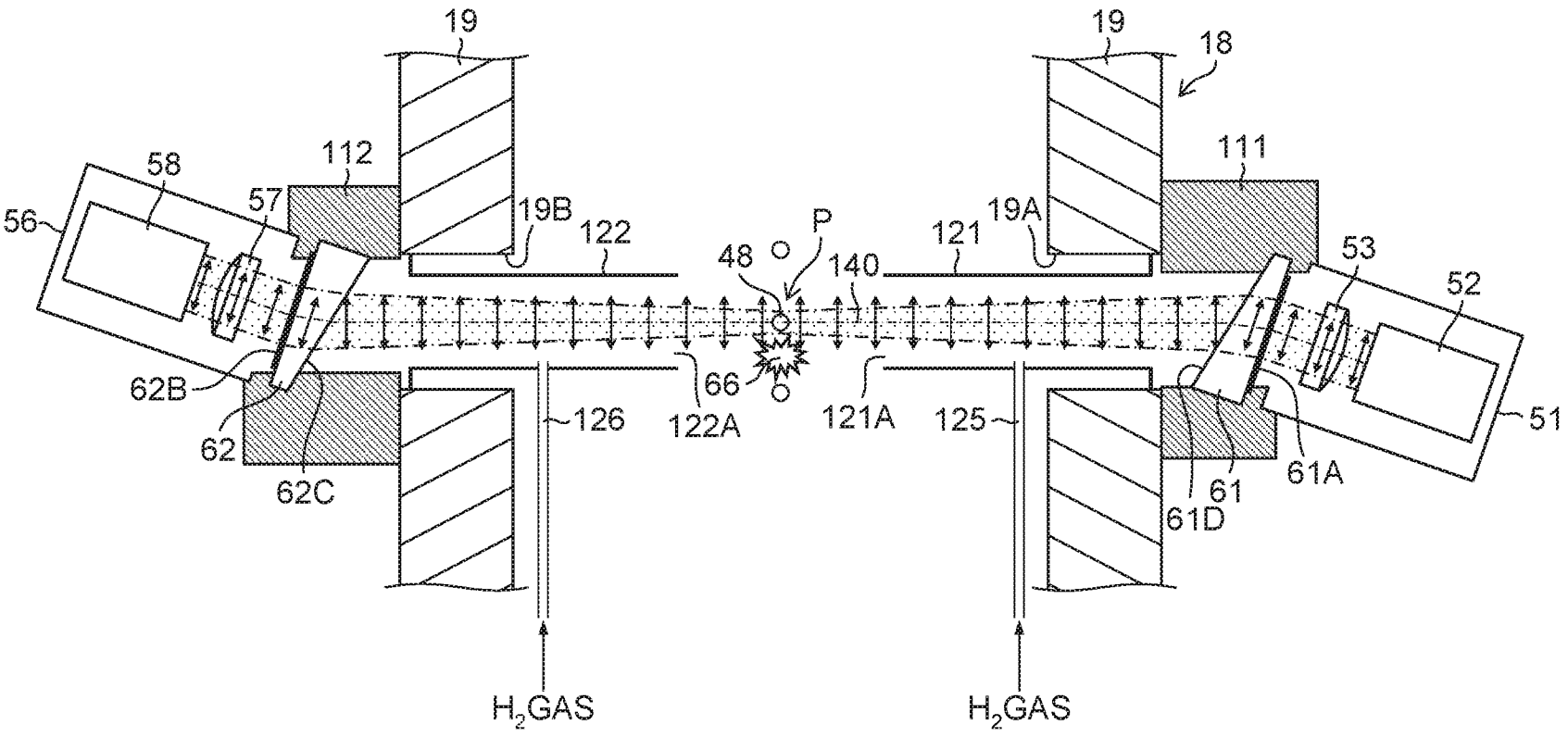
FIG. 9 is a diagram illustrating a configuration of a droplet detection sensor provided to a chamber device according to a fifth embodiment.

FIG. 9 is a diagram illustrating a configuration of a droplet detection sensor provided to a chamber device according to a fifth embodiment. Regarding the fifth embodiment illustrated in FIG. 9, a difference from the configuration described in FIG. 5 will be described. The configuration illustrated in FIG. 9 is adoptable in place of the configuration described in FIG. 5.

Decompression side surfaces of the first window 61 and the second window 62 are non-coated surfaces that are not applied with anti-reflection films. Meanwhile, atmospheric side surfaces of the first window 61 and the second window 62 have anti-reflection films 61A and 62B, respectively. Each of the first window 61 and the second window 62 of the fifth embodiment is a wedge window using a wedge substrate. The wedge angle may be an angle at which reflected light from the window surface does not enter the light source 52 or the optical sensor 58 of the light receiving unit 56.

In the case of using a light source that emits light having a large amount of p-polarized components as the light source 52, the decompression side surface of the wedge substrate may be disposed at an incident and emission angle with which p-polarized light transmittance is increased.

9.2 Operation

Operation of the droplet detection sensor 50 according to the fifth embodiment illustrated in FIG. 9 is similar to the operation of the droplet detection sensor described in FIG. 3.

9.3 Effect

According to the fifth embodiment, it is possible to decrease a drop of the window transmittance of measurement light compared with the configuration having both-side non-coated window, while suppressing the time degradation and aging variation of the measurement device. Thereby, it is possible to suppress a loss of light amount of the measurement light caused by reflection at the window surface.

10. Sixth Embodiment 10.1 Configuration

Figure 10:
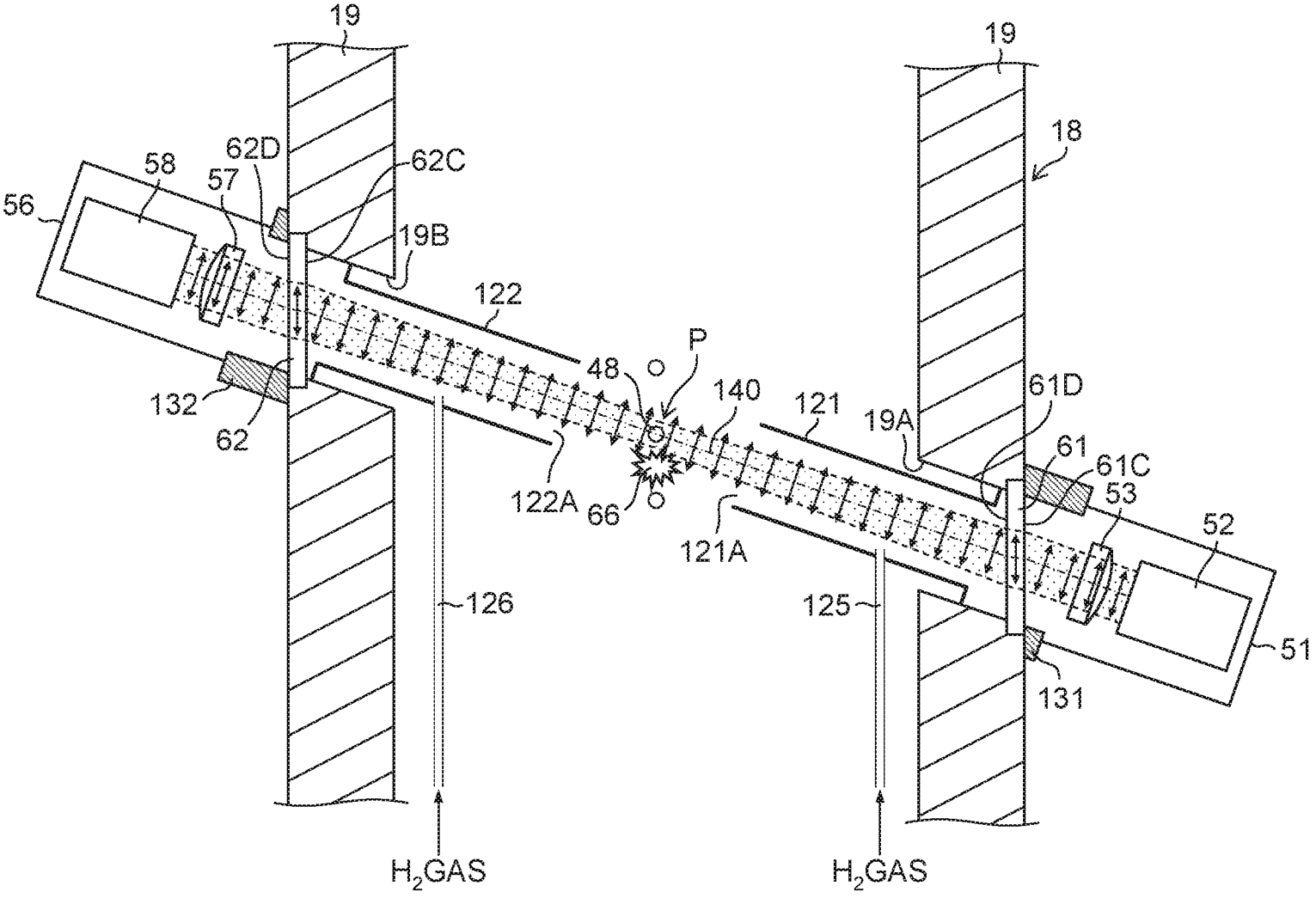
FIG. 10 is a diagram illustrating a configuration of a droplet detection sensor provided to a chamber device according to a sixth embodiment.

FIG. 10 is a diagram illustrating a configuration of a droplet detection sensor 50 provided to a chamber device according to a sixth embodiment. Regarding the sixth embodiment illustrated in FIG. 10, a difference from the configuration described in FIG. 5 will be described. The configuration illustrated in FIG. 10 is adoptable in place of the configuration described in FIG. 5.

The first window 61 and the second window 62 may be disposed in parallel with the inner wall extending direction of the chamber 18. Each of the first window 61 and the second window 62 is a both-side non-coated flat window not applied with an anti-reflection film.

The first window 61 is disposed parallel to the chamber inner wall extending direction, on the wall 19 of the chamber 18 by a first window fixing member 131. The second window 62 is disposed parallel to the chamber inner wall extending direction, on the wall 19 of the chamber 18 by a second window fixing member 132. However, the first window 61 and the second window 62 are disposed to be inclined at a non-perpendicular angle against an observation optical axis. The observation optical axis means an optical axis of illumination light output from the light source 52 and/or illumination light received by the light receiving unit 56. The optical axis 140 of measurement light emitted from the light source 52 corresponds to the observation optical axis. The observation optical axis is arranged such that light is made incident on the first window 61 and the second window 62 at the Brewster's angle. In that case, it is preferable to use the light source 52 that outputs light having a large amount of p-polarized components.

10.2 Operation

Operation of the droplet detection sensor 50 according to the sixth embodiment illustrated in FIG. 10 is similar to the operation of the droplet detection sensor described in FIG. 3.

10.3 Effect

According to the sixth embodiment, it is possible to suppress time deterioration and aging variation of the measurement device, and to prevent an adverse effect on the measurement caused by the reflected light from the window surface.

The description provided above is intended to provide just examples without any limitations. Accordingly, it will be obvious to those skilled in the art that changes can be made to the embodiments of the present disclosure without departing from the scope of the accompanying claims.

The terms used in the present description and in the entire scope of the accompanying claims should be construed as terms "without limitations". For example, a term "including" or "included" should be construed as "not limited to that described to be included". A term "have" should be construed as "not limited to that described to be held". Moreover, an indefinite article "a/an" described in the present description and in the accompanying claims should be construed to mean "at least one" or "one or more".

What is claimed is:

1. An ultraviolet light generating device comprising:

a chamber inside which plasma is generated;

a light source disposed outside the chamber;

an incidence window configured to transmit measurement light emitted from the light source to an inside the chamber;

an emission window configured to transmit the measurement light emitted from the light source and passing through the inside of the chamber, from the inside of the chamber to an outside of the chamber;

an optical sensor disposed outside the chamber beyond the emission window, the optical sensor being configured to receive the measurement light passing through the inside of the chamber and emitted from the emission window;

a target feeding unit configured to feed a droplet of a target substance, serving as a source of generating the plasma, to the inside of the chamber; and a laser light introduction window configured to transmit laser light to be radiated to the droplet and introduce the laser light into the chamber, the incidence window having a first surface facing the outside of the chamber and a second surface facing the inside of the chamber and exposed to plasma light, at least the second surface out of the first surface and the second surface being not coated with an anti-reflection film, the second surface being disposed on a wall of the chamber in a state of being inclined at a non-perpendicular angle against an optical axis of the measurement light emitted from the light source and passing through the incidence window, the emission window including a third surface facing the inside of the chamber and exposed to the plasma light and a fourth surface facing the outside of the chamber, at least the third surface out of the third surface and the fourth surface being not coated with an anti-reflection film, the third surface being disposed on a wall of the chamber in a state of being inclined at a non-perpendicular angle against the optical axis of the measurement light emitted from the light source and passing through the emission window, a target of the droplet, supplied from the target feeding unit into the chamber, being irradiated with the laser light and made into plasma to thereby generate extreme ultraviolet light, and the light source and the optical sensor being disposed opposite to each other over a trajectory of the droplet.

2. The ultraviolet light generating device according to claim 1, wherein the second surface is directly exposed to the plasma light.

3. The ultraviolet light generating device according to claim 1, wherein the first surface is not coated with an anti-reflection film.

4. The ultraviolet light generating device according to claim 1, wherein a base material of the incidence window is synthetic quartz or sapphire.

5. The ultraviolet light generating device according to claim 1, wherein the incidence window is a flat window in which the first surface and the second surface are parallel to each other.

6. The ultraviolet light generating device according to claim 1, wherein an inclination angle of the second surface is a Brewster's angle with respect to the optical axis at an output wavelength of the light source.

7. The ultraviolet light generating device according to claim 6, wherein the light source outputs light having a relatively larger amount of p-polarized components out of the p-polarized components and s-polarized components, to the first surface of the incidence window.

8. The ultraviolet light generating device according to claim 1, wherein the inside of the chamber is provided with a gas supply path configured to supply hydrogen gas to a side of the second surface of the incidence window.

9. The ultraviolet light generating device according to claim 1, wherein the droplet is illuminated by the measurement light emitted from the light source, and the light passing through the trajectory of the droplet is received by the optical sensor, whereby at least one of passage of the droplet, a position of the droplet, and size of the droplet is detected.

10. The ultraviolet light generating device according to claim 1, wherein the fourth surface is not coated with an anti-reflection film.

11. The ultraviolet light generating device according to claim 1, wherein an inclination angle of the third surface is a Brewster's angle with respect to the optical axis at an output wavelength of the light source.

12. The ultraviolet light generating device according to claim 1, wherein the light source is a continuous-wave laser light source, and the optical sensor includes a photodiode array or a photodiode.

13. The ultraviolet light generating device according to claim 1, wherein a distance between a measurement point at which the optical axis of the measurement light is intersect with the trajectory of the droplet and a plasma generation region at which plasma is generated is designed within a range from about 2 mm to about 10 mm.

14. The ultraviolet light generating device according to claim 1, wherein an inclination angle of each of the second surface and the third surface relative to the optical axis is an angle inclined by one degree to two degrees with reference to a perpendicularly disposed state relative to the optical axis.

15. The ultraviolet light generating device according to claim 1, wherein each of the second surface and the third surface is inclined at non-parallel and non-perpendicular angle against a gravity direction.

* * * * *